US005292108A

United States Patent [19]

Sutton

[11] Patent Number: 5,292,108

[45] Date of Patent: Mar. 8, 1994

[54] AUXILIARY VEHICLE FOR ELECTRICALLY POWERING A WELL PIPE EXTRACTOR

[75] Inventor: Sydney V. Sutton, Norco, Calif.

[73] Assignee: California Production Service, Inc., Bakersfield, Calif.

[21] Appl. No.: 790,248

[22] Filed: Nov. 8, 1991

[51] Int. Cl.[5] ..... B66D 3/00; E21B 19/00; B66F 11/02

[52] U.S. Cl. ..... 254/323; 254/360; 175/203; 180/53.1

[58] Field of Search ..... 254/360, 264, 266, 279, 254/290, 316, 317, 323, 30, 325, 326, 327, 328; 175/52, 57, 85, 120, 129, 203; 173/25, 26; 166/351, 352, 359, 360; 180/53.1, 53.5; 414/22.51

[56] References Cited

U.S. PATENT DOCUMENTS

| | | | |
|---|---|---|---|
| 1,924,317 | 8/1933 | How et al. | 254/360 X |
| 1,935,811 | 11/1933 | Metcalf | 180/53.1 |
| 2,028,701 | 1/1936 | Guier et al. | 254/323 |
| 2,843,358 | 7/1958 | Anderson | 254/30 |
| 3,254,735 | 6/1966 | Wilson | 180/53.1 |
| 3,631,933 | 7/1968 | Bryant | 175/57 |
| 3,833,072 | 9/1974 | Back | 175/85 |
| 4,036,508 | 7/1977 | Eddy et al. | 180/53.1 |
| 4,591,006 | 5/1986 | Hutchinson | 175/52 |
| 4,684,306 | 8/1987 | Brewer et al. | 175/85 X |
| 4,901,805 | 2/1990 | Ali-Zade et al. | 175/52 X |

FOREIGN PATENT DOCUMENTS

| | | | |
|---|---|---|---|
| 0955193 | 4/1964 | United Kingdom | 175/203 |
| 2177143 | 1/1987 | United Kingdom | 175/52 |

*Primary Examiner*—Clifford D. Crowder
*Assistant Examiner*—Ismael Izaguirre
*Attorney, Agent, or Firm*—Lyon & Lyon

[57] ABSTRACT

An electrically powered oil well pipe extractor includes a standard well servicing rig having a winch driven by a combustion engine. An auxiliary vehicle has an electric motor connected through a transmission or torque convertor, through a drive shaft, to the winch on the well servicing rig. The combustion engine is disengaged from the winch and the winch is driven by the electric motor on the auxiliary vehicle during pipe extraction operations at a well site having electric power available. Exhaust emissions and noise are significantly reduced.

13 Claims, 2 Drawing Sheets

AUXILIARY VEHICLE FOR ELECTRICALLY POWERING A WELL PIPE EXTRACTOR

FIELD OF THE INVENTION

The field of the invention is equipment for servicing oil and gas wells.

BACKGROUND OF THE INVENTION

Oil or gas wells are typically drilled to depths of hundreds or thousands of feet. Sections of well pipe are linked together and are lowered into the well. For various reasons, it occasionally becomes necessary to pull the well pipe from the well. This can require large lifting forces since the well pipe can weigh several pounds per foot and hundreds or thousands of feet of pipe must be lifted from the well.

Specialized well servicing rigs have been used for pulling is well pipe. These rigs are generally driven to the well where a derrick on the rig is erected over the well. A winch on the rig is used to pull the well pipe from the well. Workers on an elevated platform on the derrick unhook well pipe from the winch cable and temporarily store the extracted well pipe along side the derrick. Workers on the ground around the well uncouple or separate well pipe sections as they are extracted from the well. Accordingly, the well servicing rig can extract well pipe much more quickly and easily than e.g., a general purpose crane.

The winch or draw works on the well servicing rig is typically powered by the rig's internal combustion engine. Winching accordingly generates substantial exhaust emissions and noise. When working on "town lot" wells, i.e., wells located in or near residential areas, it is especially desireable to reduce noise and emissions from operations at the well site, including pipe extraction operations. In the Southern California area, emissions from oil refineries and oil fields are limited by government regulations. Any increase in emissions generated by expanded operations, etc., must be compensated for by reduced emissions in other areas. Accordingly, there is a need to reduce all emissions associated with oil well operations in Southern California oil fields.

SUMMARY OF THE INVENTION

The present invention is directed to mobile well servicing equipment which can perform oil well servicing operations, and especially pipe extraction, with little or no exhaust emissions and substantially reduced noise levels. To this end, a well servicing rig has a winch adapted to receive an external drive shaft. An auxiliary truck has an electric motor driving a transmission or torque convertor. A drive shaft connects the transmission to the winch on the well servicing rig. The internal combustion engine on the rig ordinarily used for the winch is disengaged and the winch is driven by the electric motor on the auxiliary truck.

Accordingly, it is an object of the present invention to provide well servicing equipment which can extract well pipe with minimized emissions and noise. Other and further objects and advantages will appear hereinafter.

BRIEF DESCRIPTION OF THE DRAWINGS

In the drawings, wherein similar reference characters denote similar elements throughout the several views.

DETAILED DESCRIPTION OF THE PREFERRED EMBODIMENT

Figure 1:
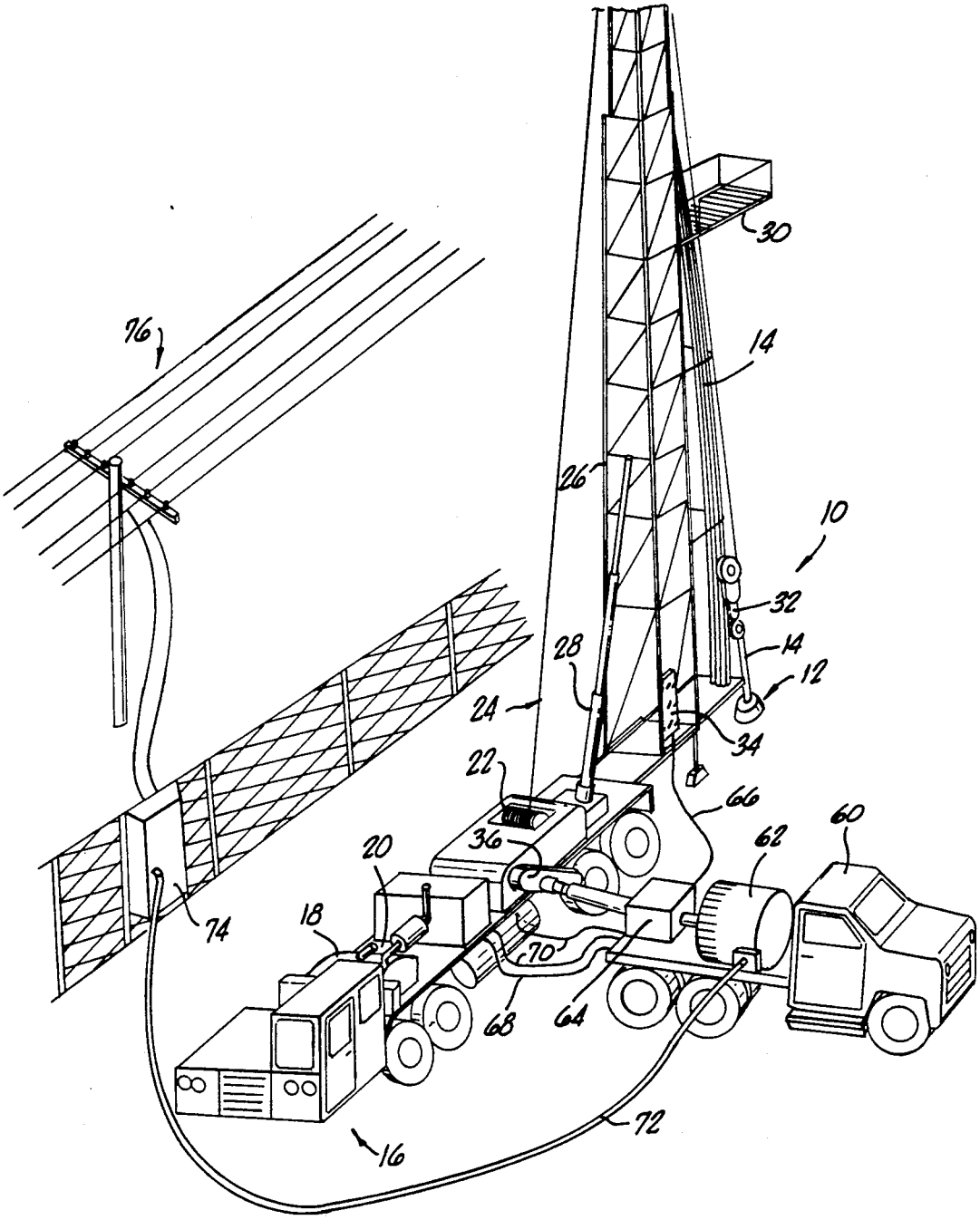
FIG. 1 is a perspective view of the present well servicing equipment operating at a well site.

Turning to the drawings, as shown in FIG. 1, a well servicing rig 16 is set up over a well 12 at a well site 10. The well servicing rig can be a Franks 300 Mobilrig available from Ingersoll-Rand Oil Field Products Company, Pampa, Tex. or other similar well servicing rig. The well servicing rig 16 has an internal combustion engine 18 (typically Diesel) linked to a transmission 20. The transmission 20 can be shifted to drive the road wheels of the rig, to move the rig 16 from site to site. The transmission 20 can also be shifted so that the engine 18 drives a winch or draw works 22. The transmission 20 also has a neutral position.

A winch cable 24 extends from the winch over the top of a derrick 26 and then down to a hook 32 mounted on sheaves. An elevator cylinder 28 is provided on the rig 16 to erect the derrick 26 over the well 12. A platform 30 is provided on the derrick 26 sufficiently above the ground to allow well pipe segments 14 to be pulled out of the well 12 and positioned along side the derrick 26. An operator's control panel 34 is provided at the back of the rig 16 adjacent to the derrick 26 to control winching operations.

In Southern California and in other areas, certain oil wells have electric power available to them or nearby, whereas other remote wells have no readily feasible source of electric power available. Where, as shown in FIG. 1, electric power is available near by to the well 12, for example, through power lines 76, the present invention finds application. Specifically, the well servicing rig 16 is driven to the well 12 powered by the engine 18, in the usual way. The derrick 26 is also erected using standard practices. However, since electric power is available at the well site 10, it has now been realized that well servicing operations can be performed with electric power, thereby dramatically reducing noise and emissions in contrast to diesel or gasoline engine power.

An auxiliary truck 60 has an electric motor 62 attached to a torque converter or transmission 64. The auxiliary truck 60 is maneuvered into position along side the winch 22 on the well servicing rig 16, as shown in FIG. 1. The electric motor 62 is connected to the source of electric power at the well site 10, for example, by a power cable 72 leading to a junction box 74 on a fence, field office or other structure linked to a power line 76.

Figure 2:
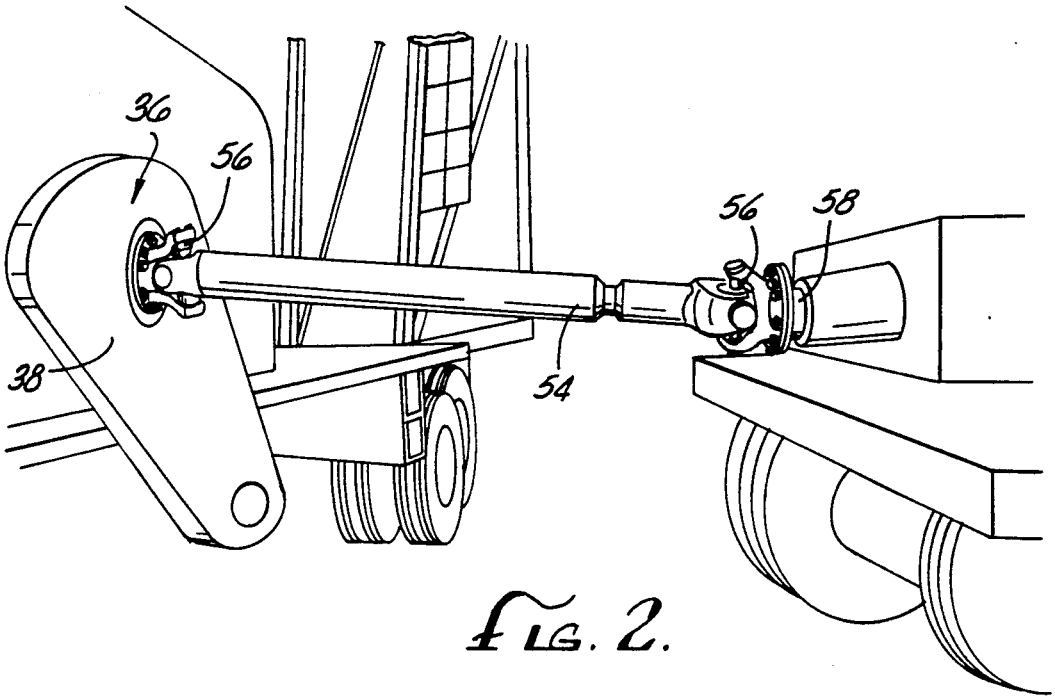
FIG. 2 is a perspective view of the drive shaft linking the auxiliary truck and well servicing rig of the present invention.
Figure 3:
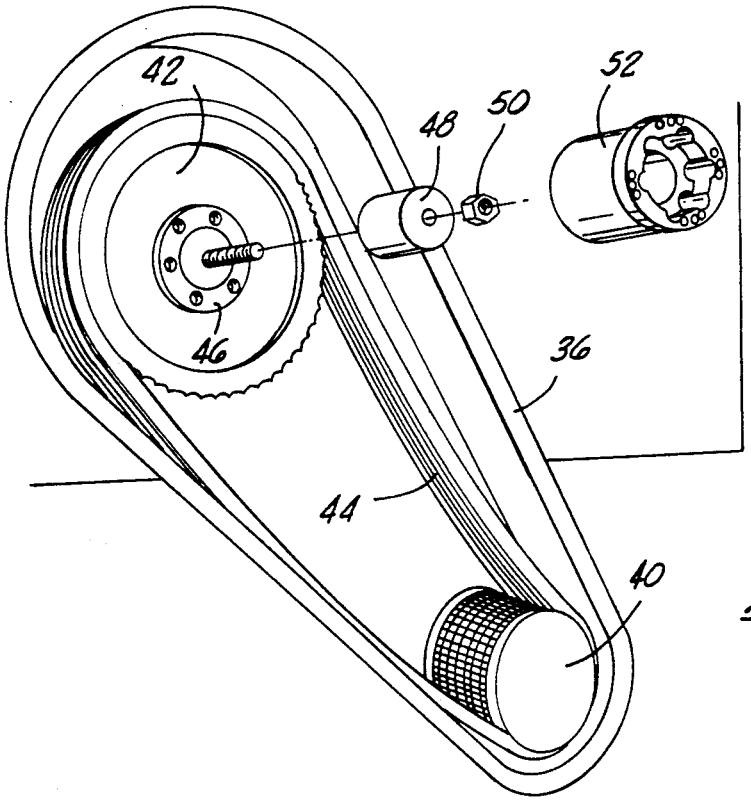
FIG. 3 is a perspective view of an adaptor for connecting the drive shaft to the winch of the well servicing rig.

Turning to FIGS. 2 and 3, the standard well servicing rigs 16 generally have a winch 22 with a winch drive housing 36 at one side. A cover plate 38 covers the winch drive housing 36. Within the winch drive housing 36 are drive sprockets 40 and driven sprockets 42 linked by roller chains 44. The drive sprockets 40 are ordinarily mechanically linked to the rig transmission 20. The driven sprockets 42 are linked to the winch drum for pulling in or letting out the winch cable 24. A hub 46 typically extends from the driven sprockets 42.

To mechanically connect the output shaft 58 driven by the electric motor 62 on the auxiliary truck 60, preferably a spacer 48 and coupler 52 are attached to the hub 46 by a nut 50. A drive shaft 54 having quick disconnect U-joints 56 at each end attaches to the coupler 52 on the well servicing rig 16 and to the output shaft 58 on the auxiliary truck 60. Suitable quick disconnect U-joints 56 are available from Twin Disk, Inc., Racine, Wis. and connect and disconnect via a single bolt. The U-joints allow for substantial misalignment between the driven sprockets 42 on the well servicing rig 16 and the output shaft 58 on the auxiliary truck 60. Of course, other mechanical linkage designs are available.

Referring once again to FIG. 1, with the electric motor 62 on the auxiliary truck 60 connected to the driven sprockets 42 by the drive shaft 54, the internal combustion engine 18 on the rig 16 need not be operated for well servicing operations. The mechanical linkage between the rig engine 18 and winch 22 is disconnected e.g., by shifting the rig transmission 20 into neutral, so that all mechanical power to the rig 16 is provided by the auxiliary truck 60. Electric hook up cables 68 and hydraulic lines 70 are also connected between the auxiliary truck 60 and the rig 16 to provide both hydraulic and electric power to the rig 16, via the electric motor 62 (as well as auxiliary hydraulic pumps) on the auxiliary truck 60, since the well servicing rig 16 itself has no operating power source. A control cable 66 is connected from the control panel 34 to the auxiliary truck 60 so that the electric motor 62 can be controlled during servicing operations in place of the rig engine 18. The control cable 66 may also be linked from the auxiliary truck 60 to an alternate control junction point on the rig 16.

When well servicing operations have been completed (using electric power) the power cable 72, hydraulic line 70, electric hook up cable 68, control cable 66 and drive shaft 54 including the U-joints 56 are disconnected and stored on the auxiliary truck 60. The auxiliary truck 60 can then move to link up with another rig at another well site having electric power. The well servicing rig 16 can be used with conventional diesel power when electric power is not available. The interconnections between the auxiliary truck 60, the well servicing rig 16 and the electric power source, such as the junction box 74 can be quickly connected and disconnected with a minimum of labor. The motor 62 preferably runs on 480 volt three phase power, to reduce current requirements. A compressed air starter may be provided for electric motor starting operations. Of course, various electric motor designs can be used. In addition, the electric motor 62 can also be on a trailer, a sled, etc., and need not be on a vehicle.

Thus, while a single embodiment has been shown and described, it will be apparent to those skilled in the art that many modifications may be made thereunto without departing from the spirit and the scope of the present invention.

I claim:

1. An electrically powered well pipe extractor comprising:

a well servicing rig including:

a rotatable winch drum;

a cable wrapped around the winch drum for extracting well pipe;

a combustion engine for rotating the winch drum;

means for mechanically engaging and disengaging the combustion engine and the winch;

an auxiliary vehicle having an electric motor including an output shaft; means for transferring power from the output shaft to the winch drum; and means for connecting the electric motor to a source of electric power.

2. The system of claim 1 wherein the means for transferring comprises a drive shaft having U-joints.

3. The system of claim 2 further comprising a winch drive housing on the well servicing rig, the winch drive housing containing a driven sprocket, and an adaptor attachable to the driven sprocket and to a U-joint on the drive shaft.

4. The system of claim 1 further comprising a control cable connecting a control panel on the well servicing rig to the auxiliary vehicle.

5. The system of claim 1 further comprising a hydraulic pump on the auxiliary vehicle connectable to the well servicing rig by hydraulic hoses.

6. The system of claim 1 wherein the means for connecting the electric motor to the electric power source comprises a cable.

7. The system of claim 1 wherein the electric motor comprises a three phase, 480 volt AC motor.

8. The system of claim 1 further comprising a transmission connected to the electric motor.

9. The well pipe extractor of the claim 1 wherein the auxiliary vehicle is self-propelled.

10. The well pipe extractor of claim 1 wherein the auxiliary vehicle has wheels.

11. A bore hole rig having a drawworks and road wheels, comprising:

a combustion engine on the rig;

a transmission connected to the combustion engine and shiftable to mechanically link the drawworks or the road wheels to the combustion engine;

an electrically powered auxiliary drive unit, separate from the rig; and a coupling for transferring mechanical power from the auxiliary unit to the drawworks on the rig.

12. The bore hole rig of claim 11 wherein the auxiliary drive unit comprises a vehicle.

13. The bore hole pipe pulling apparatus of claim 11 wherein the auxiliary drive unit comprises a vehicle trailer.

* * * * *